United States Patent [19]

Choi et al.

[11] Patent Number: 4,834,010

[45] Date of Patent: May 30, 1989

[54] RECIPROCATING THREAD CUTTER FOR MULTI-NEEDLE LOOPER THREAD TYPE SEWING MACHINE

[75] Inventors: Hin-Fai Choi, Hong Kong, Hong Kong; Hideo Matsushita; Masamiti Suzawa, both of Osaka, Japan

[73] Assignee: Pegasus Sewing Machine Mfg. Co., Ltd., Osaka, Japan

[21] Appl. No.: 163,695

[22] Filed: Mar. 3, 1988

[30] Foreign Application Priority Data

Mar. 3, 1987 [JP] Japan ..... 62-31342[U]

[51] Int. Cl.[4] ..... D05B 27/14; D05B 65/02

[52] U.S. Cl. ..... 112/292; 112/63; 112/165; 112/288; 112/295

[58] Field of Search ..... 112/63, 165, 295, 292, 112/288

[56] References Cited

U.S. PATENT DOCUMENTS 1,587,957 6/1926 Huber ..... 112/63
2,729,176 1/1956 Smith .
3,424,115 1/1969 Schopf .
3,424,117 1/1969 Schopf .
4,098,209 7/1978 Schopf .
4,461,229 7/1984 Angele et al. ..... 112/295 X
4,589,362 5/1986 Dusch ..... 112/292

FOREIGN PATENT DOCUMENTS 1119955 7/1968 United Kingdom ..... 112/292

*Primary Examiner*—Andrew M. Falik
*Attorney, Agent, or Firm*—Flynn, Thiel, Boutell & Tanis

[57] ABSTRACT

A thread cutter for an interlock sewing machine wherein the sewing machine has a small diameter cylindrical arm and the cloth being sewn is fed along the axis of the arm. A plurality of needles are disposed along a line orthogonal to the axis of the arm and an arcuated, movable member having a hook at its tip is pivotably supported ahead of feed dogs on the sewing machine relative to the line of feed. The arcuated, movable member is turned by means of an operative plate disposed along the axis of the arm and, in cooperation with a fixed blade, cuts threads after the cloth has been sewn.

9 Claims, 5 Drawing Sheets

RECIPROCATING THREAD CUTTER FOR MULTI-NEEDLE LOOPER THREAD TYPE SEWING MACHINE

BACKGROUND OF THE INVENTION

This invention relates to a thread cutter for a sewing machine equipped with a plurality of needles which can be used for sewing slender tubular articles such as sleeves of clothing and, particularly, to a thread cutter for a sewing machine of a type which is provided with a cylindrical arm having a small diameter, wherein the cloth being sewn is fed along the axis of said cylindrical arm, and a plurality of needles which are disposed along a direction which is orthogonal to the axis of the arm.

Various types of thread cutters for sewing machines have been proposed so far. While there has been known a thread cutter which can be mounted in a cylindrical arm and can be used in a sewing machine having a plurality of needles disposed along the axis of the cylindrical arm, there has not been known one which can be used in a sewing machine of a type wherein the diameter of the cylindrical arm is small and the needles are disposed along a direction which is orthogonal to the axis of the arm. The reason why a thread cutter is not provided for in this type of sewing machine is that a knife of the thread cutter should be advanced or retracted, avoiding the motion of feed dogs, in a direction along which the needles are aligned and there is not enough space for the thread cutter to be disposed in the arm if said arm has a small diameter, since the driving device for the knife of said thread cutter is complicated and requires a large space. For such reasons, this type of sewing machine provided very low working efficiency since threads were cut manually by operators.

SUMMARY OF THE INVENTION

An object of this invention is to provide a thread cutter which can be mounted in a sewing machine of the type as described above, i.e. a sewing machine wherein the cylindrical arm has a small diameter and the needles are disposed along a direction which is orthogonal with the axis of the arm, whereby it is contemplated to improve the working efficiency in sewing. In order to achieve the above object, the thread cutter should be designed such that it can be housed in a limited narrow space and that it will not interfere with other mechanisms such as a feeding mechanism.

This invention is characterized in that a movable knife, having a hook at its tip, is arcuated and pivotally supported beside feed dogs provided on the basal portion side of the cylindrical arm (portion opposite to the free end of the cylindrical arm). The movable knife is designed to be turned by means of an actuation mechanism disposed along the axis of the arm toward the basal portion thereof to allow the hook to advance or retract in the direction along which the needles are aligned and to cut the threads in cooperation with a fixed blade which awaits the movable knife on the way of the retractive stroke of the hook; wherein the dimension of the knife in the direction which is orthogonal to the axis of the arm and also the momentum of said movable knife can be reduced by allowing said movable knife to have an arcuated form, and thereby, the actuation mechanism for the movable knife can also be disposed on the basal side of the cylindrical arm where there is afforded enough space therefor; the dimension along the direction which is orthogonal to the axis of the arm to be required for disposing said thread cutter can be reduced by allowing the blade to wait on the way of the retractive stroke of the hook; and said movable knife is designed to have an arcuated form to detour other mechanisms, such as feed dogs, in the sewing machine so that it may not interfere the movement of said other mechanisms.

In such a constitution, the direction along which the needles are aligned may be orthogonal to the axis of the arm or have an appropriate angle relative to said axis.

The movable knife can be pivotally supported directly on the cylindrical arm or on an arbitrary mounting member in the cylindrical arm. The movable knife is preferably supported pivotally on the needle plate, since the space required for housing the movable knife can be reduced to provide a compact unit.

The actuation mechanism can be exemplified by a mechanism comprising a driving means such as an air cylinder, solenoid, etc. and an operative plate connected at one end to said driving means and at the other end to the movable knife, which plate is advanced or retracted along the axis of the arm by means of said driving means. In such mechanism, the operative plate is designed not to occupy much space for containing it, preferably, it is fitted in a guide groove formed on the rear surface of the arm cover, more preferably, fitted in a dovetail guide groove to be guided for linear motion therealong, or by means of a guiding means comprising a pair of guide slots and a pair of guide pins which fit therein to secure such linear motion.

The blade is either fixed at an appropriate position on the way of the reciprocating stroke of the hook, preferably on the needle plate, because of the reasons as mentioned above, or, as known in the prior art, can be designed to advance with a predetermined stroke to the cutting position toward the needle points interlocking with the movable knife, when the threads are to be cut thereby.

BRIEF DESCRIPTION OF THE DRAWINGS

FIGS. 2 and 3 each show a perspective view of the thread cutter to be mounted in the cylindrical arm of the sewing machine shown in FIG. 1; wherein FIG. 2 shows a state when the movable knife is in the retracted position and FIG. 3 shows a state when the movable knife is in the advanced position;

FIGS. 4 and 5 each show a rear side view of the thread cutter with the movable knife in different positions; wherein FIG. 4 shows a state when the movable knife is in the retracted position and FIG. 5 shows a state when the movable knife is in the advanced position;

DESCRIPTION OF THE PREFERRED EMBODIMENT

Figure 1:
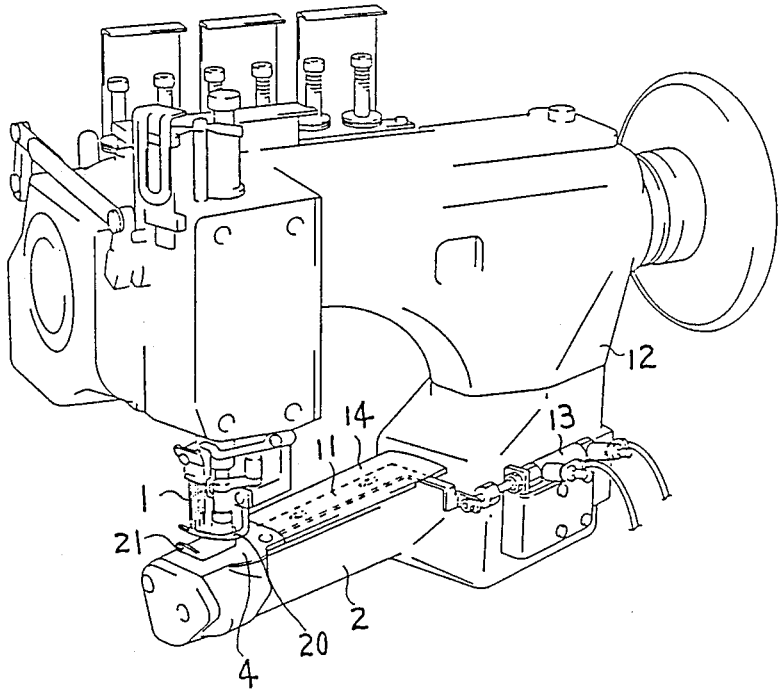
FIG. 1 shows a perspective view of a sewing machine to which the thread cutter according to this invention is mounted.
Figure 2:
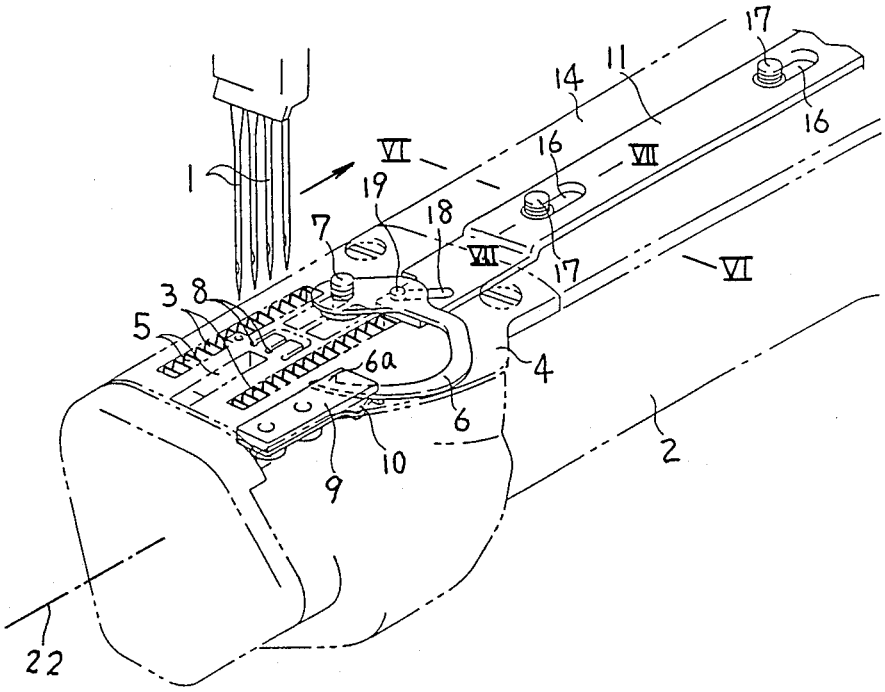
Figure 6:
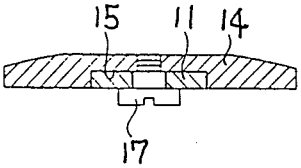
FIG. 6 shows a cross-sectional view of the arm cover taken along the line VI—VI in FIG. 2.
Figure 7:
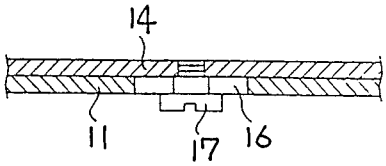
FIG. 7 shows a cross-sectional view of the arm cover taken along the line VII—VII in FIG. 2.
Figure 3:
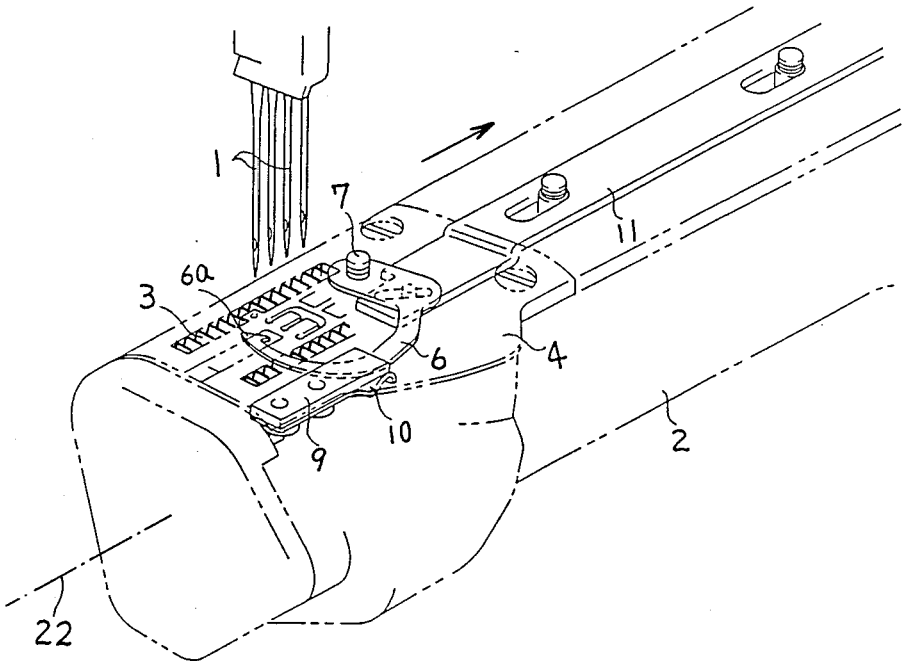
Figure 5:
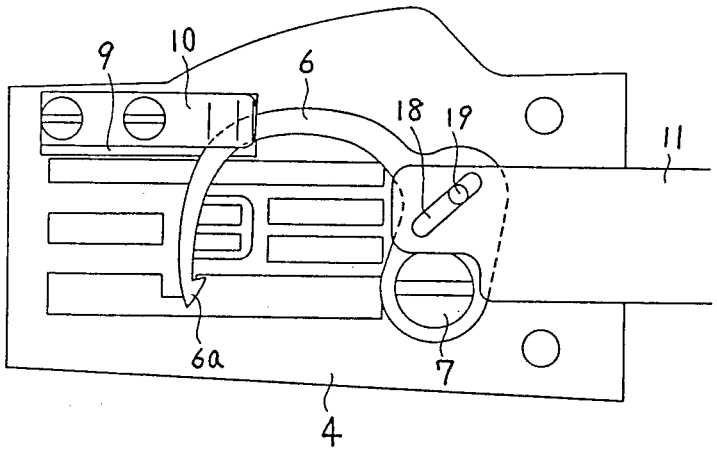
Figure 4:
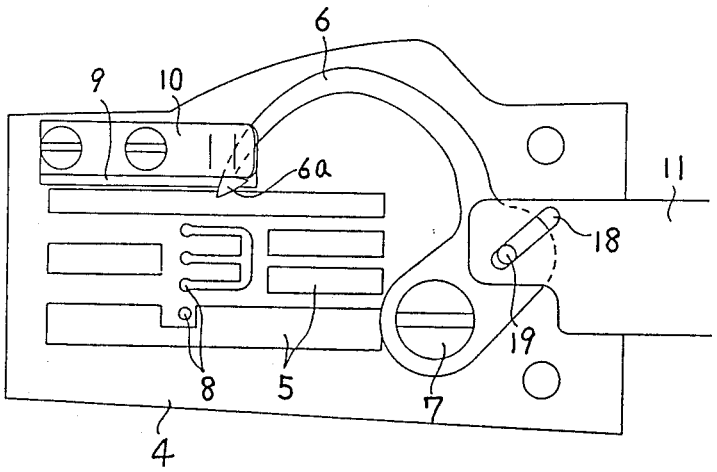
Figure 8:
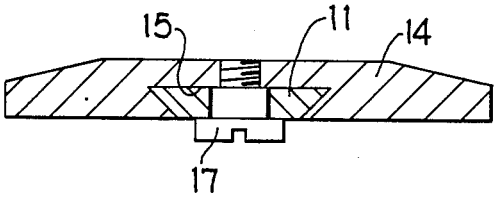
FIG. 8 is a view corresponding to FIG. 6 showing the dovetail cross-section of the elongated groove.

FIG. 1 shows an interlock sewing machine to be used for sewing slender tubular articles such as sleeves of clothing. As shown further in FIGS. 2 and 3, needles 1 are aligned in a direction which is orthogonal to the axis 22 of the arm 2 and are designed to form flat stitches (stitch type 605z) in cooperation with a looper (not shown) which oscillates in said axial direction and a spreader 20 which reciprocates above a needle plate 4, and also feed dogs 3 (see FIGS. 2 and 3) are designed to perform cloth feeding motion along the axis of the arm through holes 5 of the needle plate 4. On the rear face of the needle plate 4, a movable knife 6 curved toward the feed dogs into a form of arc and having a hooked tip (hook 6*a*) is pivotally supported at the hinge portion onto a position adjacent to and ahead of the holes relative to the line of feed (indicated by the arrows in FIGS. 2 and 3) by means of a stepped screw 7 such that the movable knife 6 can be turned along the rear face of the needle plate 4, and thus, when said movable knife 6 is turned around the stepped screw 7, the hook 6*a* at the tip thereof may be advanced or retracted along the needle holes 8 which are aligned in a direction to be orthogonal to the axis of the arm. Also, on the rear face of the needle plate, a blade 9 and a thread clamp 10 are fixed in the front side of the holes 5 to hold the movable knife 6 therebetween such that the hook 6*a* can advance toward the needle holes 8 from the position between the blade 9 and the thread clamp 10 or retract to said position. The actuation mechanism for turning the movable knife 6 comprises an operative plate 11 extending forwardly along the axis of the arm, namely toward the basal portion of the cylindrical arm and an air cylinder 13 which is connected to the end portion extending laterally from the fore end of the operative plate and mounted on the front side of the machine body 12 in the lower part. The operative plate 11 is fitted in an elongated groove 15 formed on the rear face of the arm cover 14 along the axis of said arm and supported by means of a pair of slots 16 and a pair of stepped screws 17 which are fitted to the arm cover through respective slots 16 such that said plate 11 may be slidable along the axis of the cylindrical arm. The elongated groove 15 may have a dovetail cross-section as shown in FIG. 8. A guide slot 18 is formed at the end portion of said operative plate 11 on the feed dog side diagonally relative to the axis of the arm, and a pin 19 which protrudes in the vicinity of the stepped screw 7 of the movable knife 6 is fitted in said guide slot 18 such that the operative plate 11 can slide being guided by said pin along said guide slot. Thus, when the operative plate 11 is advanced or retracted along the axis of the arm by means of the air cylinder 13, the movable knife 6 reciprocates horizontally around the stepped screw 7. It should be noted that the cylindrical arm 2 has a forward portion which is enlarged as shown in the Figures such that it will support the pivotal movement of the movable knife 6.

OPERATION

The thread cutting operation is conducted in the same manner as in the conventional type of thread cutter. To describe in detail, the tension applied to the upper threads by a thread tensioning device is removed to release the tension of the threads, and then the threads are drawn from spools by a thread releaser. At the same time, when a needle bar ascends to reach the top dead point and the sewing operation of the sewing machine is stopped, the operative plate 11 is transferred by the air cylinder 13 to the left to turn the movable knife 6 clockwise, in terms of FIGS. 2 and 3. With the turning of the movable knife 6, the hook 6*a* comes out of the position between the blade 9 and the thread clamp 10 and advances toward the needle holes 8 to go through each needle thread loop. Upon the hook 6*a* reaching the advanced extremity, the operative plate 11 is retracted by the air cylinder 13 to the right, in terms of FIGS. 2 and 3, to turn the movable knife 6 counterclockwise. With the turning of the movable knife 6, the hook 6*a* also retracts and catches the upper threads and the looper thread on the way of its retractive stroke, drawing them to the blade 9 to cut them thereby under cooperation. The cut ends of the upper threads and the looper thread are clamped between the thread clamp 10 and the movable knife through the function of the thread clamp 10 immediately after the threads are cut. The cut ends of the upper threads are drawn out and released therefrom by removing the cloth after completion of the sewing operation, and only the looper thread remains in the thread clamp. After completion of the thread cutting operation, a presser foot 21 ascends.

Since the thread cutter illustrated in the above embodiment is formed into a unit together with the needle plate and the arm cover, this invention can provide advantages, such as it can be attached to prior art sewing machines without any structural modification; it can be removed easily when the unit is not necessary; and there is no need of enlarging the diameter of the cylindrical arm by utilizing effectively the vacant space around the needle plate and the arm cover.

What is claimed is:

1. A thread cutter on a sewing machine having a cylindrical arm for supporting cloth being sewn by said sewing machine, said cylindrical arm having a free end portion, a basal end portion and a longitudinal axis, feed dogs disposed along the longitudinal axis of said cylindrical arm so that cloth fed into said sewing machine passes in a direction parallel to said longitudinal axis, a plurality of needles aligned along a direction orthogonal to said longitudinal axis, said thread cutter comprising:

an arcuated, movable member having a hook at its tip;

an actuation mechanism for moving the arcuated, movable member, said actuation mechanism being disposed in said cylindrical arm along said longitudinal axis toward said basal end portion of said cylindrical arm; and a fixed blade for cutting threads in cooperation with said arcuated, movable member after said cloth has been sewn by said sewing machine, wherein said actuation mechanism reciprocatingly advances and retracts said hook on said arcuated, movable member in a direction along the alignment of said needles to cut said threads in cooperation with said fixed blade when said hook retracts.

2. The thread cutter according to claim 1, wherein the actuation mechanism comprises an operative plate and a driving means for advancing or retracting said operative plate, said operative plate being slidably fitted in an elongated groove formed on the rear face of an arm cover along the axis of the arm.

3. The thread cutter according to claim 2, wherein the elongated groove has a dovetail cross-section.

4. The thread cutter according to claim 2, wherein a pair of guide pins protrude from either one member of the operative plate or the bottom surface of the elongated groove, and guide slots are formed in the other member so that said pins may be fitted therein and that said operative plate may be slidable along said pin or said slot.

5. The thread cutter according to claim 2, wherein said operative plate and said movable member are connected by fitting pins protruding from one of the above members into the slot formed in the other.

6. The thread cutter according to claim 1, wherein the movable member is pivotally supported on the rear face of a needle plate of the sewing machine.

7. The thread cutter according to claim 2, wherein said thread cutter is formed into an unit together with a needle plate.

8. The thread cutter according to claim 2, wherein said thread cutter is formed into a unit together with the arm cover.

9. A thread cutter on a sewing machine having a cylindrical arm for supporting cloth to be sewn by said sewing machine, said cylindrical arm having a free end portion, a basal end portion and a longitudinal axis, feed dogs disposed along the longitudinal axis of said cylindrical arm so that cloth fed into said sewing machine passes in a direction parallel to said longitudinal axis, a plurality of needles aligned along a direction orthogonal to said longitudinal axis, said thread cutter comprising:

an arcuated, movable member having a hook at its tip;

an actuation mechanism for moving the arcuated, movable member, said actuation mechanism comprising an operative plate and a driving means for advancing and retracting said operative plate, said operative plate being slidably fitted into an elongated groove formed on a rear face of an arm cover along said longitudinal axis of said cylindrical arm; and a fixed blade for cutting threads in cooperation with said arcuated movable member, wherein said actuation mechanism reciprocatingly advances and retracts said hook on said arcuated, movable member in a direction along the alignment of said needles to cut said threads in cooperation with said fixed blade when said hook retracts.

* * * * *